US005823437A

United States Patent [19]

Bolyard, Jr.

[11] Patent Number: 5,823,437

[45] Date of Patent: Oct. 20, 1998

[54] FLUID FLOW CONTROL PLATES FOR HOT MELT ADHESIVE APPLICATOR

[75] Inventor: Edward W. Bolyard, Jr., Old Hickory, Tenn.

[73] Assignee: Illinois Tool Works Inc., Glenview, Ill.

[21] Appl. No.: 734,400

[22] Filed: Oct. 16, 1996

Related U.S. Application Data

[63] Continuation-in-part of Ser. No. 683,064, Jul. 16, 1996.

[51] Int. Cl.[6] ..... B05B 1/00

[52] U.S. Cl. ..... 239/124; 239/391; 239/562

[58] Field of Search ..... 239/124, 125, 239/135, 390, 391, 553.5, 562, 566, 568; 118/62, 325; 425/7, 192; 264/12

[56] References Cited

U.S. PATENT DOCUMENTS 4,983,109 1/1991 Miller et al. ..... 425/7
5,000,112 3/1991 Rothen et al. ..... 118/41
5,620,139 4/1997 Ziecker ..... 239/124
5,683,037 11/1997 Rochman et al. ..... 239/566 X

*Primary Examiner*—Lesley D. Morris
*Attorney, Agent, or Firm*—Donald J. Breh

[57] ABSTRACT

A system usable for dispensing fluids including hot melt adhesives supplied from a reservoir onto a substrate. The system includes a fluid metering device having a plurality of metered fluid outlets for supplying fluid from the reservoir, a main manifold having an end portion with plurality of fluid outlet ports coupled to corresponding metered fluid outlets of the fluid metering device, and a corresponding plurality of fluid return ports coupled to the reservoir. At least one individual fluid flow control plate having a plate fluid inlet port on a plate fluid interface is mountable on the end portion of the main manifold to couple the plate fluid inlet port of the individual fluid flow control plate to a corresponding one of the plurality of fluid outlet ports of the main manifold. The individual fluid flow control plate includes a plate fluid outlet port coupled to the plate fluid inlet port by a plate fluid flow conduit for either recirculating back to the main manifold or directing the fluid to a fluid dispensing nozzle.

9 Claims, 4 Drawing Sheets

FLUID FLOW CONTROL PLATES FOR HOT MELT ADHESIVE APPLICATOR

CROSS-REFERENCE TO RELATED APPLICATIONS

The present application is a continuation-in-part application of U.S. application Ser. No. 08/683,064 filed on 16 Jul. 1996, entitled "Hot Melt Adhesive Applicator With Metering Gear-Driven Head", assigned to the assignee of the present application and incorporated herein by reference.

BACKGROUND OF THE INVENTION

The invention relates generally to a system for dispensing fluids including hot melt adhesives supplied from a reservoir by a fluid metering device, and more particularly to a system having one or more individual fluid flow control plates interchangeably coupled to an end portion of a main manifold, wherein each individual fluid flow control plate either recirculates fluid or directs fluid toward a fluid dispensing nozzle.

The precise dispensing of hot melt adhesives and other fluids onto substrates has many applications including, for example, the manufacture of disposable diapers and incontinence pads, sanitary napkins, patient underlays, and surgical dressings, which require bonding one or more layers of material, or substrates. The precise control over the amount of adhesive, or fluid, dispensed is important for a number of reasons some of which are discussed in the copending parent application incorporated herein by reference above. It is also necessary in many applications, including those applications discussed above, to control the locations where fluid is dispensed onto the substrate, which is generally performed by configuring the fluid dispensing nozzles on the fluid dispensing system to dispense a specified pattern. Existing fluid dispensing systems, however, are not generally reconfigurable for dispensing different fluid patterns. And fluid dispensing systems that are reconfigurable require substantial disassembly and modification, which is time consuming and must be performed usually by a skilled technician.

The inventor of the present invention recognizes that it is desirable to conditionally recirculate fluid as a means for dynamic fluid pressure regulation as more fully disclosed in the copending parent application incorporated herein by reference above. The inventor of the present invention also recognizes that it is desirable and advantageous to recirculate fluid supplied to fluid outlet ports through which fluid dispensing is not desired without utilizing dynamic fluid pressure regulation, and at the same time dynamically regulating fluid pressure related to fluid outlet ports through which fluid dispensing is desired by conditionally recirculating fluid only when the fluid pressure related to these ports increases beyond some acceptable fluid pressure level, resulting possibly from an obstructed fluid dispensing nozzle. These various features are not disclosed or known in prior art fluid dispensing systems, and particularly in systems for dispensing hot melt adhesives supplied from a reservoir by one or more fluid metering devices.

In view of the discussion above, there exists a demonstrated need for an advancement in the art of fluid flow control in a fluid dispensing system.

It is therefore an object of the invention to provide a novel system for dispensing fluids including hot melt adhesives through one or more individual fluid flow control plates mountable on or to an end portion of a main manifold that overcomes problems in the prior art.

It is another object of the invention to provide a novel system for dispensing fluids including hot melt adhesives supplied from a reservoir by a fluid metering device having a plurality of metered fluid outlets, wherein one or more individual fluid flow control plates are interchangeably mountable onto an end portion of a main manifold to provide improved flexibility and control over fluid dispensed and recirculated by the main manifold.

It is also an object of the invention to provide novel systems having a main manifold for dispensing fluids including hot melt adhesives supplied from a reservoir by a fluid metering device, wherein at least one individual fluid flow control plate is coupleable to an end portion of the main manifold, and wherein the individual fluid flow control plate is an individual fluid blocking plate for recirculating fluid from a fluid supply conduit of the main manifold to a fluid recirculation conduit of the main manifold, or wherein the individual fluid flow control plate is an individual direct fluid flow nozzle adapter plate for directing fluid from the fluid supply conduit of the main manifold to a fluid dispensing nozzle.

It is also an object of the invention to provide novel systems having a main manifold for dispensing fluids including hot melt adhesives supplied from a reservoir by a fluid metering device, wherein a plurality of individual fluid flow control plates are coupleable to an end portion of the main manifold having a plurality of fluid flow outlet ports, and the plurality of individual fluid flow control plates are coupleable to a common fluid return plate, wherein the common fluid return plate is also coupled to the main manifold for recirculating fluid from one or more individual fluid flow control plates back to the main manifold.

It is still another object of the invention to provide novel systems having a main manifold for dispensing fluids including hot melt adhesives supplied from a reservoir by a fluid metering device, wherein at least one individual fluid flow control plate is coupleable to an end portion of the main manifold, and wherein the main manifold includes a plurality of recirculation conduits each interconnectable between a corresponding one of the plurality of fluid supply conduits and the reservoir by a corresponding one-way valve disposed between each fluid supply conduit and the reservoir, wherein the one-way valve conditionally recirculates fluid from the corresponding fluid supply conduit toward the reservoir.

It is a further object of the invention to provide novel systems having a main manifold for dispensing fluids including hot melt adhesives supplied from a reservoir by a fluid metering device, wherein at least one individual fluid flow control plate is coupleable to an end portion of the main manifold in combination with one or more valve actuateable fluid dispensing nozzle modules.

These and other objects, features and advantages of the present invention will become more fully apparent upon consideration of the following Detailed Description of the Invention with the accompanying drawings, which may be disproportionate for ease of understanding, wherein like structure and steps are referenced by corresponding numerals and indicators.

DETAILED DESCRIPTION OF THE INVENTION

Figure 1:
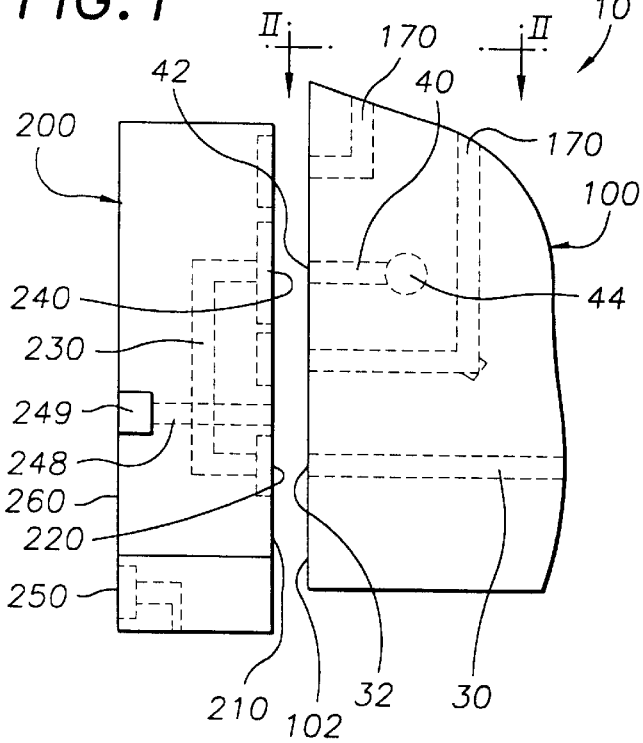
FIG. 1 is a partial side view of a hot melt adhesive dispensing system main manifold and an individual fluid blocking plate coupleable to the main manifold according to an exemplary embodiment of the invention.
Figure 9:
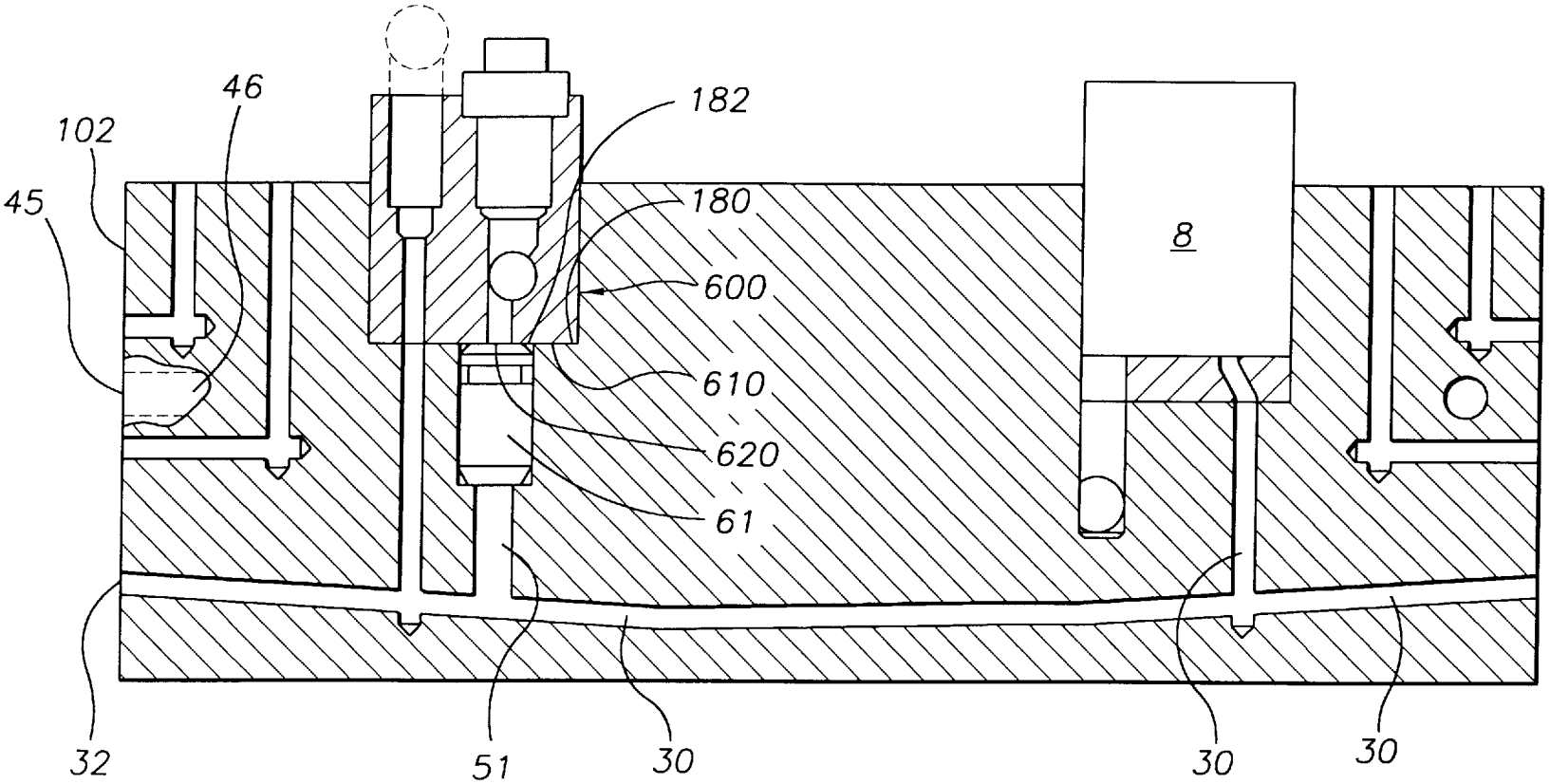
FIG. 9 is a partial side view of a hot melt adhesive dispensing system main manifold having a recirculation manifold according to an exemplary embodiment of the invention.

FIG. 1 is a partial side view of a hot melt adhesive dispensing system 10 comprising generally a main manifold 100 having a plurality of fluid supply conduits 30 each interconnecting a corresponding one of a plurality of fluid outlet ports 32 on a first end portion 102 of the main manifold with a corresponding one of a plurality of metered fluid outlets of a fluid metering device 8, illustrated in FIG. 9 which supplies fluid from a fluid reservoir as more fully disclosed in the copending parent application incorporated herein by reference above. More generally, however, the main manifold 100 includes additional end portions, not shown, having a plurality of fluid outlet ports each coupled to a corresponding one of the plurality of metered fluid outlets of the fluid metering device, wherein each end portion of the main manifold 100 has at least two fluid outlet ports 32.

Figure 2:
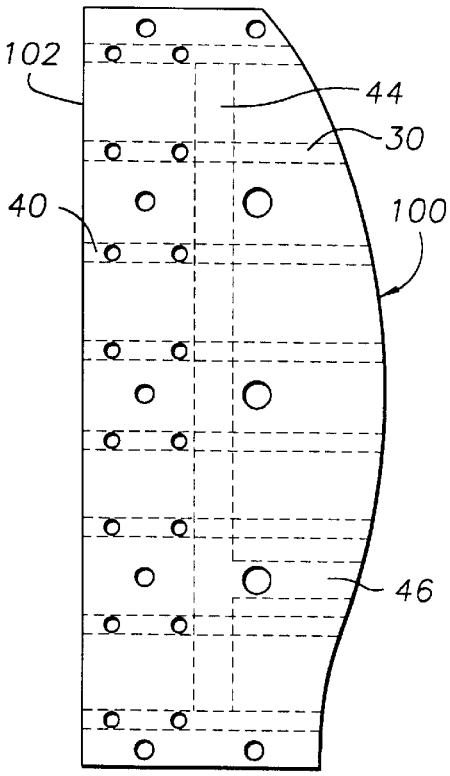
FIG. 2 is a partial plan view of the main manifold of a hot melt adhesive dispensing system taken along lines II—II of FIG. 1.

According to the exemplary embodiments of FIGS. 1 and 2, the main manifold 100 includes a plurality of fluid return conduits 40 coupling a corresponding one of a plurality of fluid return ports 42 disposed on the end portions of the main manifold 100 with the fluid reservoir. The fluid return ports 42 are coupled anywhere upstream of a fluid inlet of the fluid metering device as more fully disclosed in the copending parent application incorporated herein by reference above. In the exemplary embodiment of FIGS. 1 and 2, the plurality of fluid return conduits 40 along the first end portion 102 of the main manifold 100 are interconnected by a transverse conduit 44 coupled to a common recirculation conduit 46, which is coupled to the fluid inlet of the fluid metering device or to the fluid reservoir.

FIG. 1 shows at least one individual fluid flow control plate 200 coupled to the end portion of the main manifold 100. The individual fluid flow control plate 200 includes generally a plate fluid interface 210 having at least a plate fluid inlet port 220 coupled by a plate fluid flow conduit 230 to a plate fluid outlet port 240. The plate fluid interface 210 of the individual fluid flow control plate 200 is mountable on or to one of the end portions of the main manifold 100 to couple the plate fluid inlet port 220 of the individual fluid flow control plate 200 to a corresponding one of the plurality of fluid outlet ports 32 of the main manifold 100.

Figure 3A:
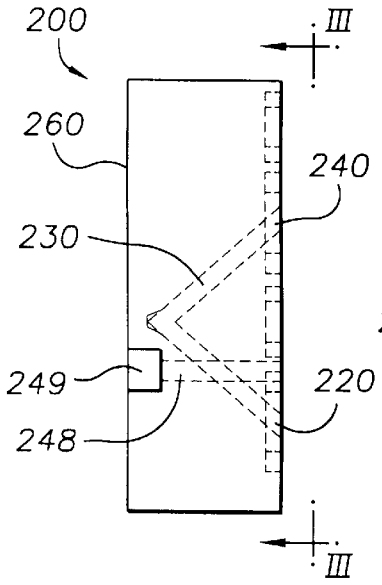
FIG. 3*a* is a side view of an individual fluid blocking plate according to an alternative embodiment of the invention.

In the exemplary embodiments of FIGS. 1 and 3*a*, the individual fluid flow control plate 200 is an individual fluid blocking plate having the plate fluid outlet port 240 disposed on the plate fluid interface 210. The plate fluid outlet port 240 is coupled to one of the plurality of fluid return ports 42 on the end portion of the main manifold 100 when the individual fluid blocking plate 200 is mounted on the main manifold 100. According to this configuration, fluid supplied to the individual fluid blocking plate 200 by a corresponding one of the plurality of fluid supply conduits 30 of the main manifold 100 is directed to a corresponding one of the plurality of fluid return conduits 40 of the main manifold 100, wherein fluid supplied by the corresponding fluid supply conduit 30 is recirculated or returned by the corresponding fluid return conduit 40 to the reservoir, which in this specification means anywhere upstream of the fluid metering device inlet.

FIG. 1 also shows an air flow inlet port 250, which may be coupled to an air outlet port of an air preheater module, not shown but more fully disclosed in the copending parent application incorporated herein by reference above, coupleable to an air interface 260 of the individual fluid flow control plate 200. The air flow inlet port 250 of the individual fluid flow control plate 200 vents air supplied from one of several air supply conduits of the air preheater module to prevent imbalance of air pressure in other air supply conduits of the air preheater module.

Figure 3B:
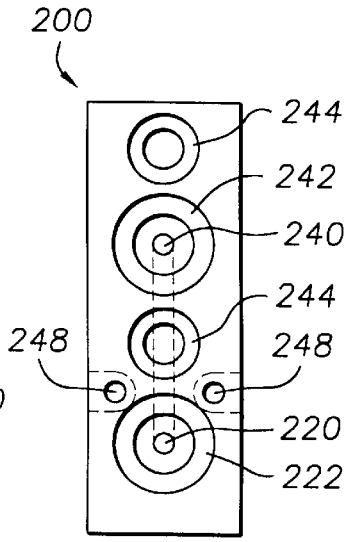
FIG. 3*b* is an end view taken along lines III—III of FIG. 3*a*.

A sealing member is generally disposed between the individual fluid flow control plate 200 and the end portion of the main manifold 100 to contain fluid flow and seal any unused ports. The exemplary embodiment of FIG. 3*b* is an end view of the individual fluid flow control plate 200 of FIG. 3*a* showing a seat 222 disposed about the plate fluid inlet port 220 and a seat 242 disposed about the plate fluid outlet port 240 for receiving corresponding O-rings or other suitable sealing members, not shown, which contain fluid flow between the main manifold 100 and the individual fluid flow control plate 200. Additional seats 244 are disposed on the fluid interface 210 of the individual fluid flow control plate 200 for receiving corresponding sealing members for blocking or sealing air supply conduits 170 in the main manifold 100, which are useable to actuate a nozzle module valve as disclosed in the copending application incorporated herein by reference above. Similar seats are arranged on the fluid interface 210 of the individual fluid flow control plate 200 of FIG. 1. And in another embodiment, the seats 222, 242, and 244 may alternatively or cumulatively be disposed on the end portion of the main manifold 100.

The individual fluid flow control plate 200 is mounted on or coupled to the main manifold 100 by bolts or other fastening members disposeable through bores 248 in the individual fluid flow control plate 200, which includes recesses 249 for countersinking bolt heads to permit mounting an air preheater manifold on the air interface 260 of the individual fluid flow control plate 200.

FIGS. 1 and 3*a* illustrate alternative plate fluid flow conduit configurations between the plate fluid inlet port 220 and the plate fluid outlet port 240. The plate fluid flow conduit 230 of FIG. 1 may be formed by drilling three holes in the individual fluid flow control plate 200, whereas the plate fluid flow conduit 231 of FIG. 3*a* may be formed by drilling two holes in the individual fluid flow control plate 200.

Figure 4:
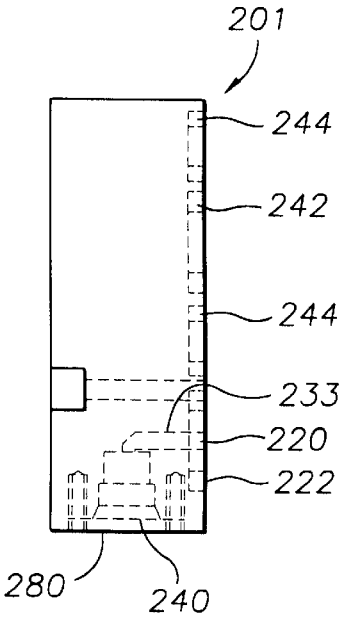
FIG. 4 is a side view of an individual direct fluid flow nozzle adapter plate coupleable to the main manifold according to another embodiment of the invention.

In the exemplary embodiment of FIG. 4, the individual fluid flow control plate is an individual direct fluid flow nozzle adapter plate 201 having the plate fluid outlet port 240 disposed on a nozzle adapter interface 280. According to this configuration fluid supplied to the individual direct fluid flow nozzle adapter plate 200 by a corresponding one of the plurality of fluid supply conduits 30 of the main manifold 100 is directed by the fluid flow conduit 233 to the plate fluid outlet port 240 on the nozzle adapter interface 280 to provide an uninterrupted direct fluid flow to a fluid dispensing nozzle, not shown, coupled to the nozzle adapter interface 280. One type of fluid dispensing nozzle coupleable to the nozzle adapter interface 280 is, for example, an A-25 type nozzle, Part No. 057-B-1893, and nozzle adapter, Part No. 084-B-1555, both available from ITW Dynatec, Hendersonville, Tenn., which are useable for dispensing hot melt adhesives.

The plate fluid flow conduit 233 in the individual direct fluid flow nozzle adapter plate of FIG. 4 may be formed by drilling a hole in the individual fluid flow control plate 201, which is coupled to a bored recess for receiving a portion of a particular fluid dispensing nozzle, which is not shown. The individual direct fluid flow nozzle adapter plate of FIG. 4 also includes a seat 222 disposed about the plate fluid inlet port 220 for receiving sealing members, not shown, for containing fluid flow between the main manifold 100 and the individual fluid flow control plate 201 as discussed above. The seat 242 receives a sealing member for sealing the fluid return port 42 of the main manifold 100, and additional seats 244 are disposed on the fluid interface 210 of the individual direct fluid flow nozzle adapter plate 201 for receiving corresponding sealing members for blocking or sealing air supply conduits 170 on the main manifold 100. In another embodiment, the seats 222, 242, and 244 may alternatively or cumulatively be disposed on the end portion of the main manifold 100. FIG. 4 may also include an air flow inlet port, which may be coupled to an air outlet port of an air preheater module as discussed above with respect to FIG. 1. And the individual direct fluid flow nozzle adapter plate 201 of FIG. 4 may be coupled to the main manifold 100 as discussed above with respect to FIGS. 1–3.

The exemplary embodiments, of FIGS. 1–4 are useable alone and in a variety of combined configurations as well as with other nozzle modules coupleable to end portions of the main manifold 100, which thereby provide maximum operational flexibility for fluid dispensing applications. In one exemplary configuration, at least one or more individual fluid blocking plates 200 of the type shown in FIGS. 1–3 are coupled to one or more of the end faces of the main manifold 100 to recirculate fluid supplied from corresponding fluid supply conduits to the fluid reservoir as defined herein. These one or more individual fluid blocking plates 200 may be used in combination with one or more individual direct fluid flow nozzle adapter plates 201 of the type shown in FIG. 4. In another exemplary embodiment, at least one or more individual direct fluid flow nozzle adapter plates 201 of the type shown in FIG. 4 are coupled to one or more of the end portions or faces of the main manifold 100 to supply fluid from corresponding fluid supply conduits 30 to fluid dispensing nozzles coupled to the nozzle adapter interface 280. These one or more individual direct fluid flow nozzle adapter plates 201 may also be used in combination with one or more individual fluid blocking plates 200 of the type shown in FIGS. 1–3. Both types of individual fluid flow control plates shown in FIGS. 1–4 are independently mountable on and removable from end portions of the main manifold 100, and may also be used in combination with valve actuateable nozzle module assemblies including the types more fully disclosed in the copending parent application incorporated herein by reference above. These valve actuatable nozzle modules include the MR-1300™ Nozzle Module available from ITW Dynatec, Hendersonville, Tenn. The MR-1300™ Nozzle Module includes seats for receiving sealing members to contain, seal and/or block fluid and air flow between the individual fluid flow control plates 200 and the main manifold 100.

According to an alternative configuration of the main manifold 100 shown in FIG. 9, a single fluid return port 45 is disposed on one or more end portions of the main manifold 100, as more fully disclosed in the copending parent application incorporated herein by reference, rather than the plurality of fluid return conduits 40 shown in the embodiments of FIGS. 1 and 2. The single fluid return port 45 may be located centrally or offset toward one side of the end portion of the main manifold 100. The single fluid return port 45 is coupled to the fluid reservoir anywhere upstream of the fluid inlet of the fluid metering device by a corresponding recirculation conduit, or single fluid return conduit, 46.

Figure 5A:
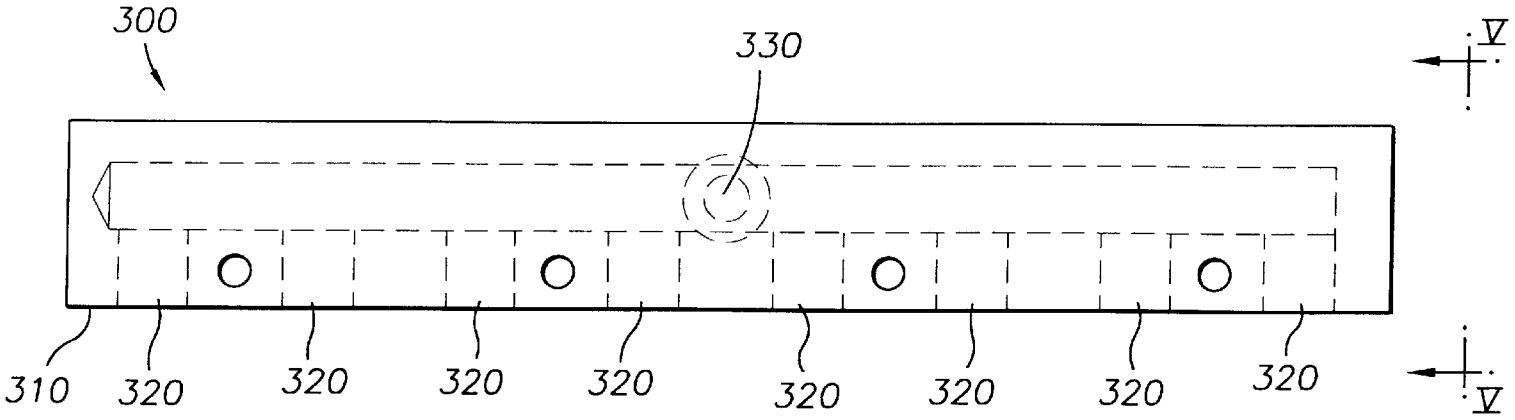
FIG. 5*a* is a front end view of a common fluid return plate coupleable to the main manifold according to another exemplary embodiment of the invention.
Figure 5B:
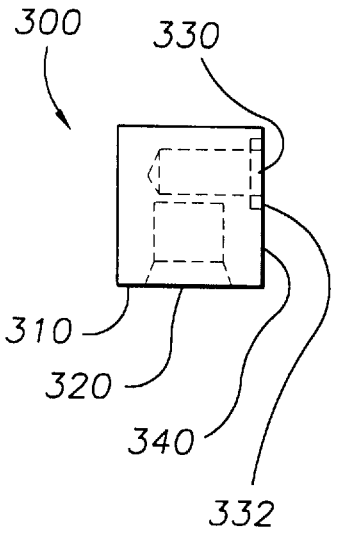
FIG. 5*b* is a side view taken along lines V—V of FIG. 5*a*.

FIGS. 5*a* and 5*b* show a common fluid return plate 300 having a first interface 310 with a plurality of fluid return inlet ports 320 coupled to a common fluid return outlet port 330 on a second interface 340 of the common fluid return plate 300. The second interface 340 of the common fluid return plate 300 is mountable on one of the end portions of the main manifold 100 to couple the common fluid return outlet port 330 of the common fluid return plate to the single fluid return port 45 of the main manifold 100. One or both the end portion of the main manifold 100 and the second interface 340 of the common fluid return plate 300 may include a seat 332 for receiving a sealing member for containing fluid between the main manifold 100 and the common fluid return plate 300 as discussed above.

Figure 6A:
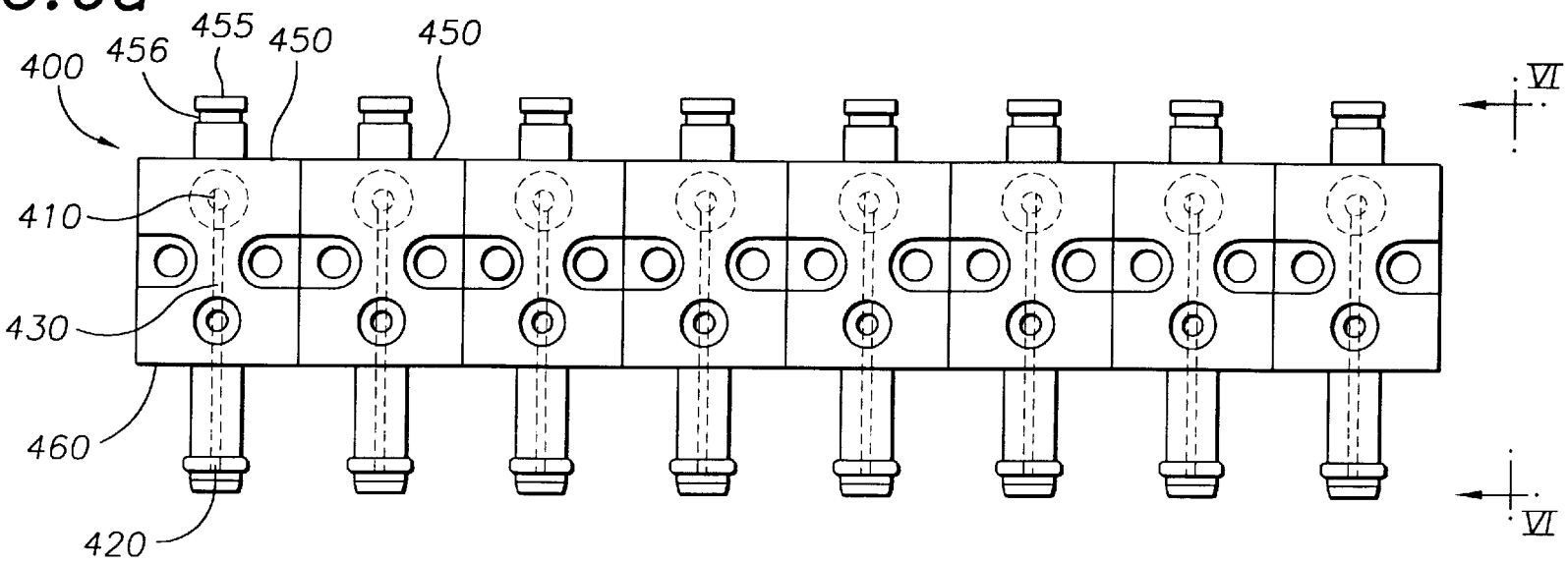
FIG. 6*a* is a front end view of a plurality of alternative individual direct fluid flow plates coupleable to the main manifold and to the common fluid return plate of FIG. 5.
Figure 6B:
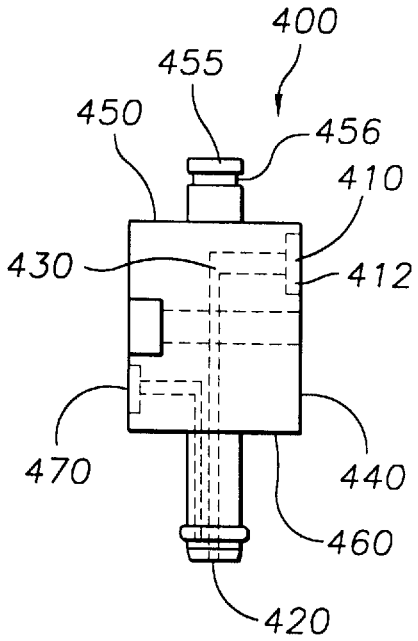
FIG. 6*b* is a side view taken along lines VI—VI of FIG. 6*a*.

FIGS. 6*a* and 6*b* show a plurality of alternative individual fluid flow control plates 400 coupleable to an end portion of the main manifold 100 and to the first interface 310 of the common fluid return plate 300. Each individual fluid flow control plate 400 includes a plate fluid inlet port 410 coupled to a plate fluid outlet port 420 by a plate fluid flow conduit 430. The plate fluid inlet port 410 is on a first plate interface 440 mountable to or on the end portion of the main manifold 100 to couple the plate fluid inlet port 410 of the individual fluid flow control plate to a corresponding one of the plurality of fluid outlet ports 32 on the end portion of the main manifold 100. According to this configuration, an individual fluid flow control plate 400 corresponds to each of the fluid outlet ports 32 of the main manifold 100 and to a corresponding one of the plurality of fluid return inlet ports 320 of the common return fluid plate 300. Each individual fluid flow control plate 400 also includes a second plate interface 450 mountable on the first interface 310 of the common fluid return plate 300. And one or more of the end portion of the main manifold 100 and the first plate interface 440 of the individual fluid flow control plate 400 include a seat 412 for receiving a sealing member for containing fluid therebetween as discussed above.

In the exemplary embodiment of FIGS. 6*a* and 6*b*, the individual fluid flow control plate is an individual direct fluid flow nozzle adapter plate 400 having the plate fluid outlet port 420 disposed on a third plate interface 460, which functions as a nozzle adapter interface. According to this configuration, fluid supplied to the individual direct fluid flow nozzle adapter plate 400 by a corresponding one of the plurality of fluid supply conduits 30 of the main manifold 100 is directed by the fluid flow conduit 430 to the plate fluid outlet port 420 on the third plate interface 460 to provide an uninterrupted direct fluid flow to a fluid dispensing nozzle, not shown, coupled to the third plate interface 460, or nozzle adapter interface. One type of fluid dispensing nozzle coupleable to the third plate interface 460 of the individual direct fluid flow nozzle adapter plate 400 is, for example, an A-25 nozzle, Part No. 057-B-1893, available from ITW Dynatec, Hendersonville, Tenn., which are useable for dispensing hot melt adhesives.

In the exemplary embodiment of FIGS. 6*a* and 6*b*, the second plate interface 450 of the individual direct fluid flow nozzle adapter plate 400 is mountable on the first interface 310 of the common fluid return plate 300 to seal the fluid return inlet port 320 of the common fluid return plate 300. In the exemplary embodiment, the individual direct fluid flow nozzle adapter plate 400 includes a protruding member 455 disposeable in the fluid return inlet port 320 of the common fluid return plate 300. The protruding member 455 includes a sealing member seat 456 for receiving an o-ring or other sealing member, not shown, which provides a seal between the second interface 450 of the individual fluid flow control plate 400 and the first interface 310 of the common fluid return plate 300 to block the fluid return inlet port 320 of the common fluid return plate 300. Similar protruding members with sealing members protruding from the third interface 460 are used for coupling with a fluid dispensing nozzle assembly mountable on the third interface 460.

Figure 7:
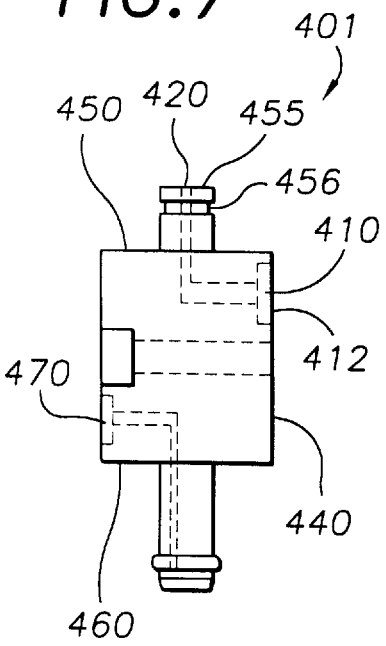
FIG. 7 is a side view of an alternative individual fluid blocking plate coupleable to the main manifold and to the common fluid return plate of FIG. 5.
Figure 8:
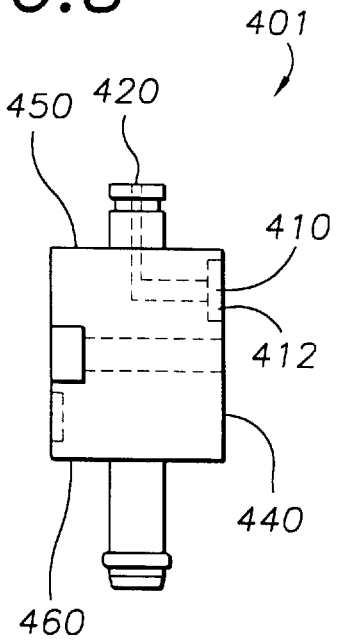
FIG. 8 is a side view of another alternative individual fluid blocking plate coupleable to the main manifold and to the common fluid return plate of FIG. 5.

In the exemplary embodiments of FIGS. 7 and 8, the individual fluid flow control plate is an individual fluid blocking plate 401 having the plate fluid outlet port 420 disposed on the second plate interface 450. The plate fluid outlet port 420 is coupled to a corresponding one of the plurality of fluid return ports 320 on the first interface 310 of the common fluid return plate 300 of FIGS. 5*a* and 5*b* when the second interface 450 of the individual fluid blocking plate is mounted on the first interface 310 of the common fluid return plate 300. According to this configuration, fluid supplied to the individual fluid blocking plate 401 by a corresponding one of the plurality of fluid supply conduits 30 of the main manifold 100 is directed to the fluid return conduit 46 of the main manifold 100 for recirculation. The protruding member 455 includes a sealing member seat 456 for receiving an o-ring or other sealing member, not shown, which provides a seal between the second interface 450 of the individual fluid flow control plate 401 and the first interface 310 of the common fluid return plate 300 to seal and contain fluid recirculated from the plate fluid outlet port 420 to the fluid return inlet port 320 of the common fluid return plate 300.

The individual fluid blocking plates 400 and 401 of FIGS. 6 and 7 also include an air flow inlet port 470, which may be coupled to an air outlet port of an air preheater module, which is not shown but is more fully disclosed in the copending parent application incorporated herein by reference above. The air flow port 470 of FIG. 6 is useable for modifying air flow through a fluid dispensing nozzle coupleable to the third interface 460 of the individual direct fluid flow nozzle adapter plate 400. And the air flow port 470 of FIG. 7 is useable for venting air supplied from one of several air supply conduits of the air preheater module to prevent air pressure imbalance as discussed above.

The individual fluid blocking plates 400 and 401 in FIGS. 6–8 are independently mountable and removable from the main manifold 100 and the common fluid return manifold 300 of FIGS. 5*a* and 5*b*. And the individual fluid blocking plates are retainable on the main manifold by fastening members and include seats for corresponding sealing members to provide seal therebetween as discussed above with respect to the embodiments of FIGS. 1 and 2. In application, the plurality of individual fluid flow control plates 400 coupled to the common fluid return plate 300 and to the main manifold 100 may be any combination of the individual direct fluid flow nozzle interface adapter plates 400 of FIGS. 6 and the individual fluid blocking plates 401 of FIGS. 7 and 8, which thereby provide maximum operational flexibility for fluid dispensing applications.

According to another aspect of the invention shown in FIG. 9, the fluid flow control plates and configurations discussed with respect to the embodiments of FIGS. 1–8 are useable in combination with a plurality of recirculation conduits 51 interconnectable between a corresponding one of the plurality of fluid supply conduits 30 and the fluid reservoir, wherein a one-way valve 61 disposed between a corresponding one of the plurality of fluid supply conduits 30 and the reservoir conditionally recirculates fluid from a corresponding fluid supply conduit 30 toward the fluid reservoir as more fully disclosed in the copending parent application incorporated herein by reference above. According to one embodiment of the invention, the main manifold 100 includes a second interface 180 with a plurality of fluid recirculation outlet ports 182. Each of the plurality of fluid supply conduits 30 is coupled to a corresponding one of the plurality of fluid recirculation ports 182 by a corresponding one of the plurality of fluid recirculation conduits 51, which is at least partially disposed in the main manifold 100.

A recirculation manifold 600 having a recirculation interface 610 with a plurality of recirculation inlet ports 620 is mountable on the second interface 180 of the main manifold 100, wherein each of the plurality of recirculation inlet ports 620 of the recirculation manifold 600 is coupled to a corresponding one of the plurality of fluid recirculation outlet ports 182 of the main manifold 100 when the recirculation interface 610 of the recirculation manifold 600 is coupled to the second interface 180 of the main manifold 100 as more fully disclosed in the copending parent application incorporated by reference herein above. According to this aspect of the invention, fluid is recirculateable from a fluid supply conduit 30 of the main manifold 100 to a corresponding fluid return conduit 40 of the main manifold 100 by an individual fluid blocking plate 200 and 401 of the types shown in FIGS. 1, 3, 7 and 8 without invoking or utilizing the conditional recirculation features of the one-way valves 61 and the fluid recirculation conduits 51, which features are most useful for regulating fluid supplied by the main manifold 100 to fluid dispensing nozzles coupled to individual direct fluid flow nozzle adapter plates 201 and 400 of the types shown in FIGS. 4 and 6 and to valve actuateable nozzle modules like the MR-1300™. An obstruction of fluid recirculated from a fluid blocking plate 200 or 401 may, however, result in a sufficient increase in fluid pressure to invoke or utilize the conditional fluid recirculation features provided by the one-way valves and the fluid recirculation conduits 51.

While the foregoing written description of the invention enables anyone skilled in the art to make and use what is at present considered to be the best mode of the invention, it will be appreciated and understood by those skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A system usable for dispensing fluids including hot melt adhesives supplied from a reservoir onto a substrate, the system comprising:

a fluid metering device having a plurality of metered fluid outlets for supplying fluid from the reservoir;

a main manifold having an end portion with a plurality of fluid outlet ports and a corresponding plurality of fluid return ports, a plurality of fluid supply conduits coupling a corresponding one of the plurality of fluid outlet ports to a corresponding metered fluid outlet of the fluid metering device, and a plurality of fluid return conduits coupling a corresponding one of the plurality of fluid return ports to the reservoir; and at least one individual direct fluid flow nozzle adapter plate having a plate fluid inlet port on a plate fluid interface mountable to the end portion of the main manifold to couple the plate fluid inlet port of the individual direct fluid flow nozzle adapter plate to a corresponding one of the plurality of fluid outlet ports of the main manifold, the individual direct fluid flow nozzle adapter plate having a plate fluid outlet port on a nozzle adapter interface, the plate fluid outlet port coupled to the plate fluid inlet port by a plate fluid flow conduit, the plate fluid outlet port on the nozzle adapter interface connectable to a corresponding fluid dispensing nozzle, fluid supplied to the individual direct fluid flow nozzle adapter plate by a corresponding one of the plurality of fluid supply conduits of the main manifold directed to the plate fluid outlet port, and the plate fluid interface of the individual direct flow nozzle adapter coupled to the end portion of the main manifold to block a corresponding one of the plurality of fluid return ports on the end portion of the main manifold.

2. The system of claim 1 further comprising at least one individual fluid blocking plate having a plate fluid inlet port on a plate fluid interface mountable to the end portion of the main manifold to couple the plate fluid inlet port to a corresponding one of the plurality of fluid outlet ports of the main manifold, the individual fluid blocking plate having a plate fluid outlet port on the plate fluid interface, the plate fluid outlet port coupled to a corresponding one of the plurality of fluid return ports on the end portion of the main manifold, wherein fluid supplied to the individual fluid blocking plate by a corresponding one of the plurality of fluid supply conduits of the main manifold is directed to a corresponding one of the plurality of fluid return conduits of the main manifold.

3. A system usable for dispensing fluids including hot melt adhesives supplied from a reservoir onto a substrate, the system comprising:

a fluid metering device having a plurality of metered fluid outlets for supplying fluid from the reservoir;

a main manifold having an end portion with a plurality of fluid outlet ports and a corresponding plurality of fluid return ports, a plurality of fluid supply conduits coupling a corresponding one of the plurality of fluid outlet ports to a corresponding metered fluid outlet of the fluid metering device, and a plurality of fluid return conduits coupling a corresponding one of the plurality of fluid return ports to the reservoir;

a plurality of fluid recirculation conduits, each fluid recirculation conduit interconnectable between a corresponding one of the plurality of fluid supply conduits and the reservoir;

a plurality of one-way valves, each one-way valve disposed between a corresponding fluid supply conduit and the reservoir for conditional recirculation of fluid from the corresponding fluid supply conduit toward the reservoir; and at least one individual fluid flow control plate having a plate fluid inlet port on a plate fluid interface mountable to the end portion of the main manifold to couple the plate fluid inlet port to a corresponding one of the plurality of fluid outlet ports of the main manifold, and the individual fluid flow control plate having a plate fluid outlet port coupled to the plate fluid inlet port by a plate fluid flow conduit.

4. The system of claim 3 further comprising a second interface on the main manifold having a plurality of fluid recirculation outlet ports, each of the plurality of fluid supply conduits coupled to a corresponding one of the plurality of fluid recirculation outlet ports by a corresponding one of the plurality of fluid recirculation conduits at least partially disposed in the main manifold, and a recirculation manifold having a recirculation interface with a plurality of recirculation inlet ports, each of the plurality of recirculation inlet ports of the recirculation manifold coupled to a corresponding one of the plurality of fluid recirculation outlet ports of the main manifold when the recirculation interface of the recirculation manifold is coupled to the second interface of the main manifold.

5. A system usable for dispensing fluids including hot melt adhesives supplied from a reservoir onto a substrate, the system comprising:

a fluid metering device having a plurality of metered fluid outlets for supplying fluid from the reservoir;

a main manifold having an end portion with a plurality of fluid outlet ports and a fluid return port, a plurality of fluid supply conduits coupling a corresponding one of the plurality of fluid outlet ports to a corresponding metered fluid outlet of the fluid metering device, and a fluid return conduit coupling the fluid return port to the reservoir;

a common fluid return plate having a first interface with a plurality of fluid return inlet ports coupled to a common fluid return outlet port on a second interface of the common fluid return plate, the second interface of the common fluid return plate mountable on the end portion of the main manifold to couple the common fluid return outlet port of the common fluid return plate to the fluid return port of the main manifold, a plurality of individual fluid flow control plates, each fluid flow control plate having a plate fluid inlet port on a first plate interface mountable to the end portion of the main manifold to couple the plate fluid inlet port of the individual fluid flow control plate to a corresponding one of the plurality of fluid outlet ports of the main manifold, and each individual fluid flow control plate having a plate fluid outlet port coupled to the plate fluid inlet port by a plate fluid flow conduit.

6. The system of claim 5 wherein at least one of the plurality of individual fluid flow control plates is an individual fluid blocking plate having the plate fluid outlet port on a second plate interface, the plate fluid outlet port coupled to a corresponding one of plurality the fluid return inlet ports on the first interface of the common fluid return plate, wherein fluid supplied to the individual fluid blocking plate by a corresponding one of the plurality of fluid supply conduits of the main manifold is directed to the fluid return conduit of the main manifold.

7. The system of claim 5 wherein at least one of the plurality of individual fluid flow control plates is an individual direct fluid flow nozzle adapter plate having the plate fluid outlet port on a third plate interface, the individual direct fluid flow nozzle adapter plate having a second plate interface, wherein fluid supplied to the individual direct fluid flow nozzle adapter plate by a corresponding one of the plurality of fluid supply conduits of the main manifold is directed to the plate fluid outlet port on the third plate interface of the individual direct fluid flow nozzle adapter plate, and wherein the second plate interface is coupled to the first interface of the common fluid return plate to block a corresponding one of the plurality of fluid return inlet ports on the first interface of the common fluid plate.

8. The system of claim 6 further comprising a plurality of fluid recirculation conduits, each fluid recirculation conduit interconnectable between a corresponding one of the plurality of fluid supply conduits and the reservoir, and a plurality of one-way valves, each one-way valve disposed between a corresponding fluid supply conduit and the reservoir for conditional recirculation of fluid from the corresponding fluid supply conduit toward the reservoir.

9. The system of claim 6 further comprising a second interface on the main manifold having a plurality of fluid recirculation outlet ports, each of the plurality of fluid supply conduits coupled to a corresponding one of the plurality of fluid recirculation outlet ports by a corresponding one of the plurality of fluid recirculation conduits at least partially disposed in the main manifold, and a recirculation manifold having a recirculation interface with a plurality of recirculation inlet ports, each of the plurality of recirculation inlet ports of the recirculation manifold coupled to a corresponding one of the plurality of fluid recirculation outlet ports of the main manifold when the recirculation interface of the recirculation manifold is coupled to the second interface of the main manifold.

* * * * *